US012768628B2

(12) United States Patent
Hucker et al.

(10) Patent No.: US 12,768,628 B2
(45) Date of Patent: Oct. 20, 2026

(54) FUZE SYSTEM, MUNITION, AND METHOD

(71) Applicant: BAE SYSTEMS PLC, London (GB)

(72) Inventors: Martyn John Hucker, Monmouthshire (GB); Lucy Garland, Monmouthshire (GB)

(73) Assignee: BAE SYSTEMS PLC, London (GB)

( * ) Notice: Subject to any disclaimer, the term of this patent is extended or adjusted under 35 U.S.C. 154(b) by 0 days.

(21) Appl. No.: 19/102,513

(22) PCT Filed: Jul. 26, 2023

(86) PCT No.: PCT/GB2023/051966
§ 371 (c)(1),
(2) Date: Feb. 10, 2025

(87) PCT Pub. No.: WO2024/033605
PCT Pub. Date: Feb. 15, 2024

(65) Prior Publication Data

US 2025/0377192 A1 Dec. 11, 2025

(30) Foreign Application Priority Data

Aug. 10, 2022 (EP) ..... 22275105
Aug. 10, 2022 (GB) ..... 2211664

(51) Int. Cl.
*F42C 11/04* (2006.01)
*F42C 11/00* (2006.01)
*F42C 15/295* (2006.01)

(52) U.S. Cl.
CPC ..... *F42C 11/008* (2013.01); *F42C 11/04* (2013.01); *F42C 15/295* (2013.01)

(58) Field of Classification Search
CPC ..... F42C 11/00; F42C 11/001; F42C 11/008; F42C 11/04; F42C 15/295
(Continued)

(56) References Cited

U.S. PATENT DOCUMENTS 2,990,776 A * 7/1961 Clarke ..... F42C 15/295 102/208
3,611,943 A * 10/1971 Popper ..... F42C 15/295 102/225
(Continued)

FOREIGN PATENT DOCUMENTS

WO WO2008108869 A2 9/2008
WO WO2024033605 A1 2/2024

OTHER PUBLICATIONS

International Search Report and Written Opinion received for PCT/GB2023/051966. Mail date: Oct. 10, 2023. 8 pages.
(Continued)

*Primary Examiner* — James S Bergin
(74) *Attorney, Agent, or Firm* — Arcane Law PLLC

(57) ABSTRACT

According to the present disclosure, there is provided a fuze system for attaching to a munition body, the fuze system comprising: a body comprising a foremost section; a fuze located in the body; a power generator, attached to the body, for generating electrical power and providing it to the fuze system, the power generator configured to generate electrical power by interacting with an airstream around the fuze system, wherein at least a part of the power generator is located behind the foremost section, the at least a part of the power generator being arranged to rotate relative to the foremost section of the body.

18 Claims, 4 Drawing Sheets

(58) Field of Classification Search
USPC ..... 102/202.5, 207, 209
See application file for complete search history.

(56) References Cited

U.S. PATENT DOCUMENTS

| | | | | |
|---|---|---|---|---|
| 4,004,519 | A | 1/1977 | Hopkins | |
| 4,080,869 | A * | 3/1978 | Karayannis | F42C 11/04 102/209 |
| 4,214,533 | A * | 7/1980 | Fine | F42C 11/04 310/263 |
| 7,316,186 | B1 | 1/2008 | Robinson et al. | |
| 11,525,654 | B2 * | 12/2022 | Thoren | H02K 7/183 |
| 11,573,069 | B1 * | 2/2023 | Parrow | F42C 11/008 |
| 2020/0284569 | A1 | 9/2020 | Feda | |
| 2020/0292287 | A1 | 9/2020 | Thoren et al. | |

OTHER PUBLICATIONS

Extended European Search Report received for EP Application No. 22275105.9, dated Jan. 16, 2023. 6 pages.
Search Report under Section 17(5) received for GB Application No. 2211664.4, dated Feb. 2, 2023. 3 pages.

* cited by examiner

FUZE SYSTEM, MUNITION, AND METHOD

FIELD

The present invention relates generally to a fuze system for attaching to a munition, such as a munition or munition assembly that is adapted to be launched, into the air, from a gun barrel. A related munition and method are also provided.

BACKGROUND

Munitions are provided in a number of different forms, for a number of different applications. Typically, a particular munition will be used for a particular application or intention. For the purposes of this patent application, munitions are taken to include but are not limited to artillery shells and charges, missiles, rockets, and mortar rounds.

Existing artillery fuze electronics derive electrical power from so-called energisers (ampoule-type reserve batteries), typically Lithium Thionyl Chloride energisers. These specialised batteries are expensive and, with limited sources worldwide, potential for supply chain disruption is high. Furthermore, Lithium Thionyl Chloride energisers pose a number of health, safety and environmental hazards because the ingredients present therein are toxic and corrosive, as well as likely to explode if malfunctioning. Disposal of Lithium Thionyl Chloride energisers thus poses a significant challenge. In addition, the battery life of such energisers is limited and thus might not be suitable for use with longer range targets. A different approach is therefore required in order to provide a safe, inexpensive power source for munition fuzes, in particular artillery fuzes, capable of meeting the electrical power demands for long range targets.

Furthermore, in existing fuze systems, power generating componentry is provided at a foremost section of a fuze system body. However, such arrangements may impede the field of regard (FOR) of various sensors, such as target sensors. Currently, space in the fuze system is highly limited. As a result, it is impractical or not feasible to relocate fuze subsystems to improved locations, including relocating sensors.

It is an example aim of example embodiments of the present invention to at least partially avoid or overcome one or more disadvantages of the prior art, whether identified herein or elsewhere, or to at least provide a viable alternative to existing apparatus and methods.

SUMMARY

According to a first aspect of the invention, there is provided a fuze system for attaching to a munition body, the fuze system comprising: a body comprising a foremost section; a fuze located in the body; a power generator, attached to the body, for generating electrical power and providing it to the fuze system, the power generator configured to generate electrical power by interacting with an airstream around the fuze system, wherein at least a part of the power generator is located behind the foremost section, the at least a part of the power generator being arranged to rotate relative to the foremost section of the body.

In one example, the at least a part of the power generator comprises a plurality of airstream engaging elements.

In one example, the airstream engaging elements are configured to interact with the airstream around the fuze system such that the at least a part of the power generator rotates around the at least a portion of the body.

In one example, the airstream engaging elements comprise recesses, channels, and/or grooves.

In one example, the at least a part of the power generator is a rotatable section of the power generator.

In one example, the power generator is located behind the foremost section. That is, in one example, the entire power generator is located behind the foremost section.

In one example, the body further comprises an aftmost section, the at least a part of the power generator located between the foremost section and aftmost section of the body, the at least a part of the power generator being arranged to rotate relative to the foremost section and aftmost section of the body.

In one example, the power generator is located between the foremost section and aftmost section of the body.

In one example, the power generator comprises a rotor and a stator.

In one example, the power generator comprises a variable reluctance alternator.

In one example, the rotor is fixedly connected to the at least a part of the power generator.

In one example, the rotor has the form of a ring, the rotor being arranged to rotate about the stator, optionally wherein the rotor comprises a plurality of teeth, preferably 2 to 6 teeth, most preferably 6 teeth.

In one example, the power generator is configured to provide electrical power to a safe and arm mechanism.

In one example, the power generator is employed as a sensor to provide a sensing input. The sensing input may be provided to the safe and arm mechanism. The sensing input may be provided to a navigation system.

In one example, at least a part of the power generator is freely rotatable around at least a portion of the body.

In one example, the power generator is arranged to generate electrical power when the rotational velocity of the rotor is different from the rotational velocity of the stator.

In one example, the power generator is arranged to generate electrical power when the rotational velocity of the rotor is different from the rotational velocity of the stator.

In one example, an outermost diameter of the power generator does not extend beyond an outermost diameter of the body.

In one example, an outer profile of the fuze system at a point of attaching to the munition body is the same as an outer profile of the munition such that, when attached to the munition body, the fuze system substantially continues the outer profile of the munition body.

In one example, an outer profile of the power generator at a point of attaching to the body is the same as an outer profile of the body such that, when attached to the body, the power generator substantially continues the outer profile of the body.

In one example, the fuze comprises an electronic fuze.

According to a second aspect of the present invention, there is provided a munition comprising the fuze system according to the first aspect.

In one example, in the second aspect, fuze subsystems are housed in the foremost section of the body and/or the aftmost section of the body.

In one example, in the second aspect, the munition is a spin-stabilised munition, an aerodynamically stabilised munition, or a projectile, optionally a self-propelled projectile or an un-propelled projectile. In one example, the munition is a mortar. An aerodynamically-stablilised munition may be a smoothbore tank munition or a mortar round. A self-propelled projectile may be a missile or rocket-assisted artillery round. An un-propelled munition may be a munition that does not employ propulsion or comprise a propulsion unit during flight (e.g., post-launch). It will be appreciated that, in an un-propelled munition, propulsion will be employed at the launch stage, According to a third aspect of the present invention, there is provided a method of using a fuze system, the fuze system comprising: a body comprising a foremost section; a fuze located in the body; a power generator, attached to the body, for generating electrical power and providing it to the fuze system, the power generator configured to generate electrical power by interacting with an airstream around the fuze system, wherein at least a part of the power generator is located behind the foremost section, the at least a part of the power generator being arranged to rotate relative to the foremost section of the body, the method comprising: generating electrical power using the power generator.

According to a fourth aspect of the present invention, there is provided a fuze system for attaching to a munition body, the fuze system comprising a body, a fuze located in the body, and a power generator, attached to the body, for generating electrical power and providing it to the fuze system, the power generator configured to generate electrical power by interacting with an airstream around the fuze system. Thus, a safe, inexpensive power source for munition fuzes, capable of meeting the electrical power demands for long range targets, is provided. The system is integrated, in that a separate power source (e.g. wind power generator) and fuze or fuze system is not needed. This improves use, maintenance, reliability, and allows for easy retrofitting to existing munitions, or interchanging with existing fuze systems to improve upon their functionality.

At least a part of the power generator may be freely rotatable around at least a portion of the body. Thus, electrical power can be generated based on the relative rotation of the power generator to the rest of the system/munition.

The power generator may comprise a rotor and a stator. Thus, electrical power can be generated due to a rotational velocity of the rotor relative to the stator.

The power generation may be arranged to generate electrical power when the rotation velocity of the rotor is different from the rotational velocity of the stator. Thus, electrical power can be generated due to a rotational velocity of the rotor relative to the stator.

The power generator may comprise a plurality of airstream engaging elements. The airstream engaging elements interact with the airstream around the projectile in order to aid power generation.

The airstream engaging elements may be configured to interact with the airstream around the fuze system such at least a part of the power generator rotates around the at least a portion of the body. The airstream engaging elements interact with the airstream around the projectile in order to aid power generation by enhancing the spinning motion of at least part of the projectile.

The airstream engaging elements may comprise recesses, channels, and/or grooves. That is, all typically extending into/below a general surrounding surface. Thus, the airstream engaging elements may be easy to manufacture, and are not easily damageable by manual handling.

An outermost diameter of the power generator may not extend beyond an outermost diameter of the body. Thus, the munition maintains its aerodynamic shape, and the risk of damaging the power generator when handling and/or during launch of the munition can be reduced.

The fuze system may be configured to be attached to a front of the munition body. Thus, the fuze system can easily be attached to existing munitions and does not take up the entirety of the munition body.

An outer profile of the fuze system at a point of attaching to the munition body may be the same as an outer profile of the munition such that, when attached to the munition body, the fuze system may substantially continue the outer profile of the munition body. Thus, the munition maintains its aerodynamic shape, and the risk of damaging the fuze system when handling and/or during launch of the munition can be reduced.

An outer profile of the power generator at a point of attaching to the body may be the same as an outer profile of the body such that, when attached to the body, the power generator may substantially continue the outer profile of the body. Thus, the fuze system maintains its aerodynamic shape, and the risk of damaging the power generator when handling and/or during launch of the munition can be reduced.

The fuze system may comprise an electronic fuze. Electronic fuzes can, in general, be safer than mechanical alternatives.

According to a fifth aspect of the invention, provided is a munition comprising the fuze system according to the first aspect. Thus, a safe, inexpensive power source for munition fuzes, capable of meeting the electrical power demands for long range targets, is provided.

The munition may be a projectile, optionally an unpropelled projectile. Thus, the cost of a munition comprising the fuze system described herein can be kept low, as the fuze system is not applied to a complex, and typically expensive, weapon.

According to a sixth aspect of the invention, provided is a method of using a fuze system, the fuze system comprising a body, a fuze located in the body, and a power generator, attached to the body, for generating electrical power and providing it to the fuze system, the power generator configured to generate electrical power by interacting with an airstream around the fuze system, the method comprising the step of generating electrical power using the power generator. Thus, a safe, inexpensive power source for munition fuzes, capable of meeting the electrical power demands for long range targets, is provided.

BRIEF DESCRIPTION OF THE FIGURES

Embodiments of the invention will now be described by way of example only with reference to the figures, in which.

DETAILED DESCRIPTION

As discussed above, there are numerous disadvantages associated with existing apparatus and fuze systems for attaching to a munition body. These range from the safety, health and environmental hazards posed by the existing fuze systems, to the difficulty obtaining components therefor and thus potential for supply chain disruption, or the significant expense associated with the existing fuze systems. For instance, existing systems might require a fuze system at one end of a munition to be somehow connected to and used with a power generator at an opposite end. In general, there exists no relatively inexpensive, safe, flexible, yet simple design that would provide power to the fuze system while also meeting the electrical power demands for long range targets.

According to the present disclosure, it has been realised that the problems associated with existing approaches can be overcome in an inexpensive, safe and effective manner. In particular, the present disclosure provides a fuze system for a munition. The munition comprises an explosive charge and a fuze. The munition is adapted to be launched, into the air. Importantly, the munition may be adapted to be launched from a gun barrel. This means that the munition typically (and practically likely) includes, or is at least used in conjunction with, a propelling explosive, and is capable of being explosively propelled and withstanding such explosive propulsion.

The munition will typically be a projectile, therefore being unpropelled and/or including no form of self-propulsion. This means that the munition is relatively simple and inexpensive.

Figure 1:
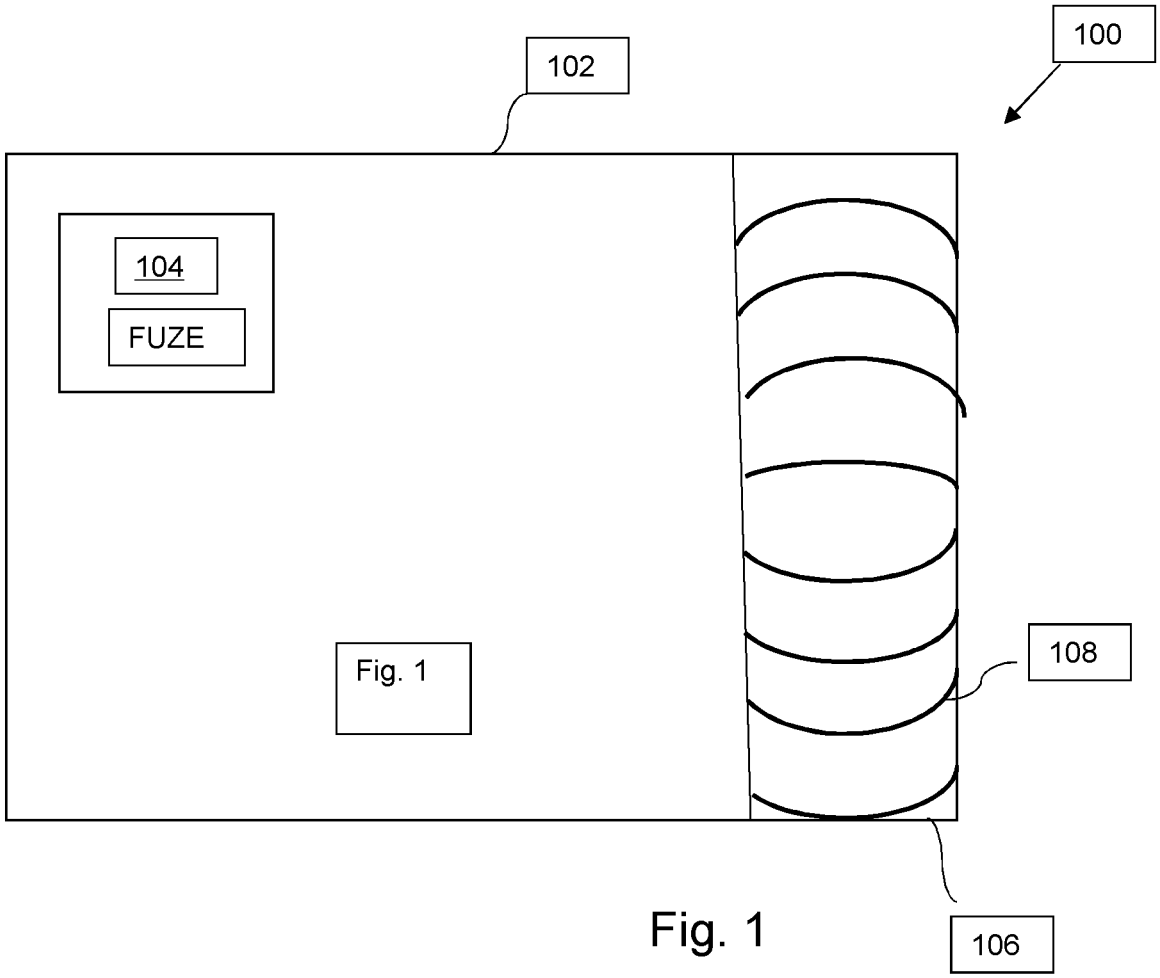
FIG. 1 shows a fuze system.

FIG. 1 schematically depicts a fuze system in accordance with an example. In this example, the fuze system 100 for attaching to a munition body comprises a body 102. Located inside the body 102 is a fuze 104. The fuze 104 initiates an explosive function in a munition, causing it to detonate or release its contents, when the activation conditions have been met. The fuze system 100 also comprises a power generator 106, attached to the body 102, arranged to generate electrical power and to provide it to the fuze system 100. For example, the power generator 106 may be used to supply electrical power for sensors used in and/or with the fuze system (such as impact sensors), various communication and control modules, and/or to supply power to an electrical fuze. The output of such sensors may be used as an input to a safe and arm mechanism.

Important is that the fuze system 100 is very well integrated with its constituent a power generator 106—these are not separate, remote components, located at different ends or sides of a munition.

The fuze 104 may be an electronic fuze. The fuze system 100 as described herein may allow electronic fuzing to be more widely applied across a greater range of munition types. Electronic fuzes can, in general, be safer than mechanical alternatives.

In particular, the power generator 106 is configured to generate electrical power by interacting with an airstream around the fuze system 100. In one example, the power generator 106 is a wind-driven power generator. Interaction of the power generator 106 with the airstream around the fuze system 100 may occur after a munition (the body of which the fuze system 100 is attached to) has been launched into the air, for example from a gun barrel. The advantage of the power generator 106 is that, since the power generator is configured to generate electrical power by interacting with the airstream around the fuze system, the need to employ a chemical energiser is eliminated.

As discussed above, energisers typically used with munition fuzes, such as Lithium Thionyl Chloride energisers, not only contain toxic and corrosive ingredients (making disposal thereof difficult and costly), but also pose an explosion risk if malfunctioning. Furthermore, such energisers are typically very costly, increasing the total cost of the fuze systems that they are employed in. This is undesirable especially in cases where the fuze systems are to be used on simple, unpropelled munitions, for example simple projectiles such as artillery munitions. Furthermore, as battery life of such energisers is limited (typically approximately 2-3 minutes of runtime), they may not be compatible with the duration of future, longer range targets. Since the amount of power provided by such energisers is limited, sensors such as proximity sensors may not be powered sufficiently, causing issues in particular in situations where an output of the proximity sensor is used to arm the fuze. In addition, activation times of conventional energisers are typically quite long.

By generating the electrical power by interacting with the airstream around the fuze system 100, the power generator 106 may generate power for the entire duration of the flight of the munition that the fuze system 100 is attached to. As such, the fuze system 100 does not run out of electrical power for the duration of the flight. Furthermore, by using renewable energy to provide electrical power to the fuze system 100, the negative effects on the environment can be reduced.

At least a part of the power generator 106 may be freely rotatable around at least a portion of the body 102, effectively acting as an alternator. In one particular example, the power generator 106 may comprise a rotor and a stator, generating electrical power based on relative rotation of the rotor and the stator, for example when the rotational velocity of the rotor is different from the rotational velocity of the stator.

The power generator 106 may comprise a plurality of airstream engaging elements 108. The airstream engaging elements 108 may be configured to interact with the airstream around the fuze system 100 such that at least a part of the power generator 106 rotates around at least a portion of the body 102. The airstream engaging elements 108 may comprise recesses, channels, and/or grooves. Such elements 108 can aid in minimising drag of the munition. In an example, the airstream around the fuze system 100 may enter the recesses or interact with the airstream elements 108 in any other manner, to thereby enhance the rotational motion of the power generator 106, improving the electrical power generation. In one specific example, the airstream engaging elements 108 may comprise spiralling recesses.

An outermost diameter of the power generator 106 may not extend beyond an outermost diameter of the body 102. In particular, an outer profile of the power generator 106 at a point of attaching to the body 102 may be the same as an outer profile of the body 102 such that, when attached to the body 102, the power generator 106 substantially continues the outer profile of the body. This reduces drag and decreases the risk of damaging the fuze system 100 when handling, loading, ramming, and/or launching a munition that the fuze system 100 is attached to. This is in direct contrast to, for example, course-correction fuzes, where fins/vanes typically tend to extend beyond the outermost diameter of the body of the fuze system and/or a body of a munition. As discussed in more detail below, such protrusions are easily damaged, and can affect the compatibility of a munition with 105 mm calibre weapons.

Figure 2:
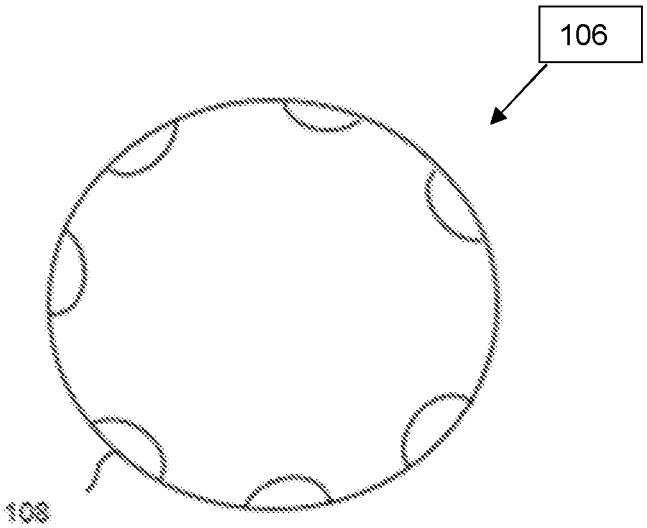
FIG. 2 shows a cross-sectional view of a power generator.

It is preferable that the airstream engaging elements 108 do not comprise any protrusions so as to not impact the external geometry of the fuze system 100. FIG. 2 schematically depicts a cross-sectional view of the power generator 106, in accordance with an example. As shown in the figure, the plurality of airstream engaging elements 108 does not extend beyond an outermost diameter of the power generator 106. That is, the airstream engaging elements 108 do not protrude beyond the outermost diameter of the power generator 106. This reduces the likelihood of damaging the power generator 106 when handling/loading, as protruding elements would be more likely to suffer such damage, or unnecessarily increase the calibre of the munition. For example, having protruding elements could cause the munition (to which the fuze system 100 is attached to) to no longer be compatible with 105 mm ranged weapons such as howitzers. Furthermore, certain protruding elements are not compatible with NATO standards regarding external profile limits for munitions, in particular for artillery and mortar charges. By ensuring that no protrusions are present in the fuze system 100, compatibility with a greater range of weapons can be achieved.

Figure 3:
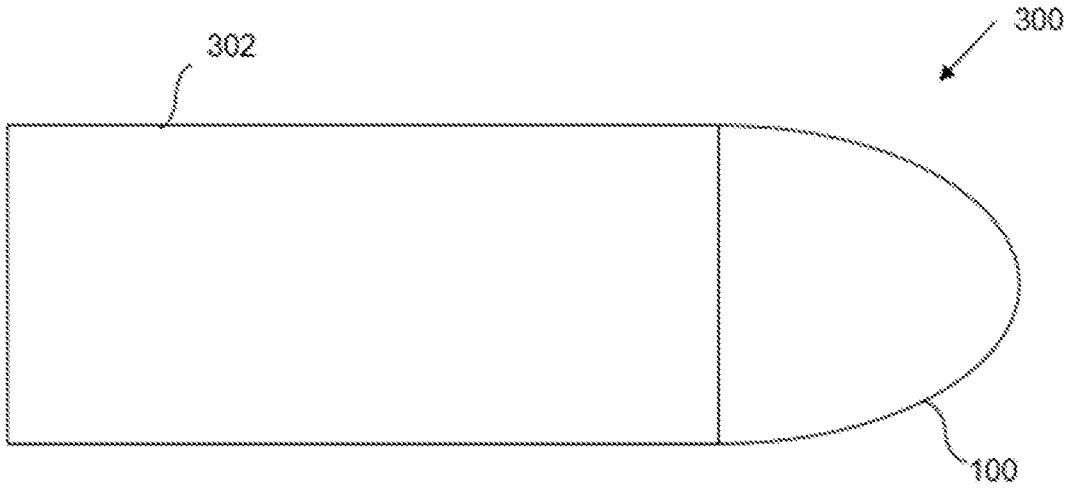
FIG. 3 shows a munition comprising the fuze system.

FIG. 3 schematically depicts a munition 300 comprising the fuze system 100, in accordance with an example. The munition 300 may comprise a projectile, optionally an unpropelled projectile. Unpropelled projectiles tend to be cheaper than its more complex alternatives, such as guided missiles. In one example, the projectile comprises an artillery munition, a mortar munition, and/or a tank munition.

As shown in FIG. 3, the fuze system 100 may be configured to be attached to a front of a munition body 302. As such, the installation of the fuze system 100 on existing munitions can be simplified. Furthermore, as the fuze system 100 is attached to a munition body 302, and is not placed within, or integral to, the munition body 302, the fuze system 100 does not take up the valuable space available within the munition body 302. As such, the munition body 302 can easily store other components (such as an explosive charge, and/or sensors) within itself, without compromising on space. That is, the fuze system 100 may modify the existing fuze, rather than modifying the entirety of the munition body 302.

Additionally, by attaching the fuze system 100 to the front of the munition body, the power generating abilities of the power generator 106 can be maximised as, in a typical scenario, the airstream engaging elements 108 get maximum exposure to the airstream around the fuze system 100. That is, the elements 108 are not obstructed, or covered by, any other elements of the munition 300.

An outer profile of the fuze system 100 at a point of attaching to the munition body 302 may be the same as an outer profile of the munition such that, when attached to the munition body 302, the fuze system 100 substantially continues the outer profile of the munition body 302. By continuing the shape of the munition body 302, drag can be minimised. In one example, the fuze system 100 may be ogive-shaped or roundly-shaped or tapering, in accordance with the typical shape of the munitions, for greater aerodynamic performance.

Furthermore, by ensuring that an outermost diameter of the fuze system 100 does not extend beyond an outermost diameter of the munition body 302 (i.e. by ensuring that the fuze system 100 does not have any protrusions that would extend beyond the outermost diameter of the munition body 302), the likelihood of damaging the fuze system 100, or indeed the munition body 302, when handling, loading, or ramming can be reduced.

A further example of a fuze system will be described below with reference to FIGS. 4 to 7. It will be readily apparent to the person skilled in the art that any or all of the features described in the above examples with reference to FIGS. 1 to 3 may be included in the fuze system described below. Furthermore, the advantages described above, for example with reference to FIGS. 1 to 3, may be also applicable in relation to the fuze system described below with reference to FIGS. 4 to 7.

Figure 4:
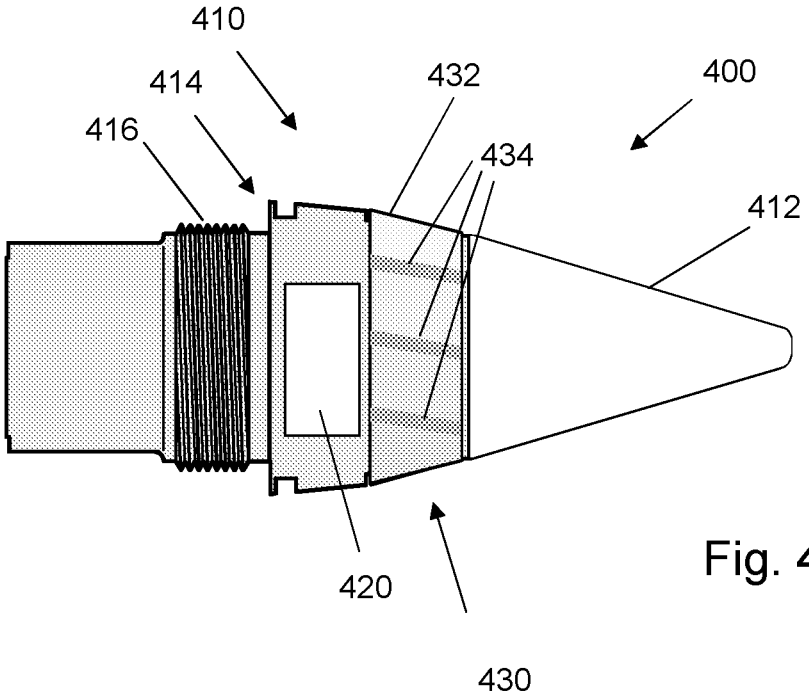
FIG. 4 shows a fuze system.
Figure 5:
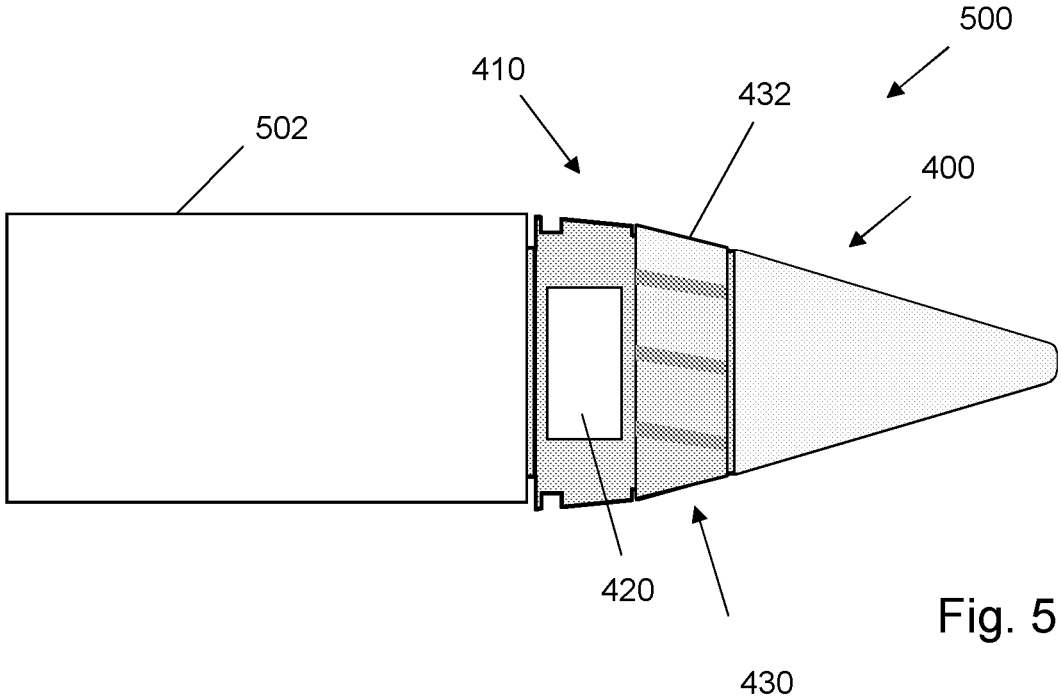
FIG. 5 shows a munition comprising the fuze system.

Referring to FIG. 4, a fuze system 400 is shown. The fuze system 400 is for attaching to a munition body 502 (as shown in FIG. 5). The fuze system 400 comprises a body 410 comprising a foremost section 412 (or foremost region 412). The foremost section 412 is defined relative to the intended travel direction of the munition 500. The foremost section 412 may be distinct from the other sections/components of the body 410. That is, the foremost section 412 may be separately formed. Alternatively, the foremost section 412 may be integral with other sections/components of the body 410. The foremost section 412 may be a nose, or tip, of the body 410.

The fuze system 400 comprises a fuze 420 located in the body 410. The fuze 420 initiates an explosive function in a munition, causing it to detonate or release its contents, when the activation conditions have been met.

The fuze system 400 comprises a power generator 430. The power generator 430 is attached to the body 410. The power generator 430 is for generating electrical power and providing the electrical power to the fuze system 400. For example, the power generator 430 may be used to supply electrical power for sensors used in and/or with the fuze system (such as impact sensors), various communication and control modules, and/or to supply power to an electrical fuze. The output of such sensors may be used as an input to a safe and arm mechanism.

Important is that the fuze system 400 is very well integrated with its constituent a power generator 430—these are not separate, remote components, located at different ends or sides of a munition.

The fuze 420 may be an electronic fuze. The fuze system 400 as described herein may allow electronic fuzing to be more widely applied across a greater range of munition types. Electronic fuzes can, in general, be safer than mechanical alternatives.

The power generator 430 is configured to generate electrical power by interacting with an airstream around the fuze system 400. In one example, the power generator 430 is a wind-driven power generator. Interaction of the power generator 430 with the airstream around the fuze system 400 may occur after a munition (the body of which the fuze system 400 is attached to) has been launched into the air, for example from a gun barrel. The advantage of the power generator 430 is that, since the power generator is configured to generate electrical power by interacting with the airstream around the fuze system 400, the need to employ a chemical energiser is eliminated.

As discussed above, energisers typically used with munition fuzes, such as Lithium Thionyl Chloride energisers, not only contain toxic and corrosive ingredients (making disposal thereof difficult and costly), but also pose an explosion risk if malfunctioning. Furthermore, such energisers are typically very costly, increasing the total cost of the fuze systems that they are employed in. This is undesirable especially in cases where the fuze systems are to be used on simple, unpropelled munitions, for example simple projectiles such as artillery munitions. Furthermore, as battery life of such energisers is limited (typically approximately 2-3 minutes of runtime), they may not be compatible with the duration of future, longer range targets. Since the amount of power provided by such energisers is limited, sensors such as proximity sensors may not be powered sufficiently, causing issues in particular in situations where an output of the proximity sensor is used to arm the fuze. In addition, activation times of conventional energisers are typically quite long.

By generating the electrical power by interacting with the airstream around the fuze system 400, the power generator 430 may generate power for the entire duration of the flight of the munition that the fuze system 400 is attached to. As such, the fuze system 400 does not run out of electrical power for the duration of the flight. Furthermore, by using renewable energy to provide electrical power to the fuze system 400, the negative effects on the environment can be reduced.

At least a part of the power generator 430 is located behind the foremost section 412. The at least a part of the power generator 430 is arranged to rotate relative to the foremost section 412 of the body 410.

The at least a part of the power generator 430 being located behind the foremost section 412 may otherwise be referred to as the at least a part being at the rear of the foremost section 412. This may be relative to an intended travel direction of the fuze system 400 in-flight. Thus, the foremost section 412 may be said to be upstream, and the at least a part of the power generator 430 is behind the foremost section 412 so as to be downstream, relative to an airflow passing over the fuze system 400 in-flight. That is, the at least a part of the power generator 430 is aft of the foremost section 412. The at least a part of the power generator 430 may be said to be at the back of the foremost section 412.

The combination of location and rotation of the at least a part of the power generator 430 is highly advantageous in combination and provides a synergistic effect. By such a construction, the foremost section 412 may be configured to remain static during flight, such that the foremost section 412 may be used for housing sensors, such as target sensors, without needing to account for rotation of the foremost section 412 of the body 410. Furthermore, by such a construction, the rotating part of the power generator 430 may be spatially separated from the foremost section 412, such that the foremost section 412 may be free of hardware (which may include rotating components) associated with the power generator 430.

Furthermore, the at least a part of the power generator 430 being located behind the foremost section 412 is highly advantageous. In this way, the foremost section 412 of the body 410 need not be used for housing the power generator 430. Improved used of space in the body 410 of the fuze system 400 is thus made. Additionally, the foremost section 412 is thus available for other fuze subsystems. For example, sensors, such as target sensors, may be located in the foremost section 412 of the body 410, where the sensors are provided with a clear field of regard, thus improving accuracy of the munition 500 and/or correct initiation time of the munition 500.

The at least a part of the power generator 430 being arranged to rotate relative to the foremost section 412 of the body 410 is highly advantageous. By this construction, electrical power generation is facilitated in a location away from the foremost section 412, thus enabling other componentry to be housed in the foremost section 412 of the body 410.

The at least a part of the power generator 430 may be a rotatable section 432 of the power generator 430. The rotatable section 432 may be an annular section, or ring, which may be a conical ring or tapered ring. A conical ring, or tapered ring, provides aerodynamic advantages. The rotatable section 432 may be, provide, or comprise, a rotor (as will be described further herein). The rotatable section 432 may be configured to run on a bearing. The bearing may be an aft thrust bearing.

In this example, another part of the power generator 430 may not rotate relative to the foremost section 412. The another part may be a stationary/fixed section of the power generator 430. The another part may be a stator. The stationary/fixed section may be, provide, or comprise, a toothed armature (as will be described further herein), one or more permanent magnets and/or one or more coils.

In a highly advantageous example, the power generator 430 (i.e., the entire power generator 430 unit) is located behind the foremost section 412, and the rotatable section 432 of the power generator 430 is arranged to rotate relative to the foremost section 412 of the body 410. In this way, the foremost section 412 is free of (i.e., absent) componentry of the power generator 430, such that the foremost section 412 can be utilised for other fuze subsystems. That is, improved use of space in the body 410 is facilitated.

The at least a part of the power generator 430 may comprise a plurality of airstream engaging elements 434. That is, in one example, the rotatable section 432 comprises a plurality of airstream engaging elements 434. In this way, power generation is assisted, enhanced and/or improved. Furthermore, this power generation is achieved away from the foremost section 412 of the body 410, such the foremost section 412 can be utilised for other fuze subsystems and purposes.

The airstream engaging elements 434 may be configured to interact with the airstream around the fuze system 400 such that at least a part of the power generator 430 rotates around at least a portion of the body 410. Advantageously, the airstream engaging elements 434 interact with the airstream around the projectile in order to aid power generation by enhancing the spinning motion of the at least a part of the power generator 430.

The airstream engaging elements 434 may comprise recesses, channels, and/or grooves. Such elements 434 can aid in minimising drag of the munition. In an example, the airstream around the fuze system 400 may enter the recesses or interact with the airstream elements 434 in any other manner, to thereby enhance the rotational motion of the power generator 430, improving the electrical power generation. In one specific example, the airstream engaging elements 434 may comprise spiralling recesses.

The body 410 further comprises an aftmost section 414 (or aftmost region 414 or rearmost section 414). The aftmost section 414 is defined relative to the intended travel direction of the munition 500. The aftmost section 414 may be distinct from the other sections/components of the body 410. That is, the aftmost section 414 may be separately formed. Alternatively, the aftmost section 414 may be integral with other sections/components of the body 410. The aftmost section 414 may extend from the power generator 430 to the rear of the body 410. The aftmost section 414 may comprise an outer screw thread 416. The outer screw thread 416 of the aftmost section 414 may engage a inner screw thread provided at the munition body 502. Thus, the fuze system 400 may be attached to the munition body 502.

The at least a part of the power generator 430 is located between the foremost section 412 and the aftmost section 414 of the body 410. The at least a part of the power generator 430 is arranged to rotate relative to the foremost section 412 and the aftmost section 414 of the body 410.

This combination of location and rotation of the at least a part of the power generator 430 is highly advantageous in combination and provides a synergistic effect. By such a construction, the foremost section 412 and aftmost section 414 may be configured to remain static during flight, such that the foremost section 412 and aftmost section 414 may be used for housing other fuze subsystems, without needing to account for rotation of the foremost section 412 and aftmost section 414 of the body 410. For example, sensors (such as target sensors), a safe and arm mechanism, the fuze 420 and a booster charge, may be provided in the foremost section 412 and/or aftmost section 414. Furthermore, by such a construction, the rotating part of the power generator 430 may be spatially separated from the foremost section 412 and aftmost section 414, such that the foremost section 412 and aftmost section 414 may be free of hardware (which may include rotating components) associated with the power generator 430.

Furthermore, the at least a part of the power generator 430 being located between the foremost section 412 and aftmost section 414 is highly advantageous. In this way, the foremost section 412 and aftmost section 414 of the body 410 need not be used for housing the power generator 430. Improved used of space in the body 410 of the fuze system 400 is thus made. Additionally, the foremost section 412 and aftmost section are thus available for other fuze subsystems. For example, sensors, such as target sensors, may be located in the foremost section 412 and/or aftmost section 414 of the body 410, where the sensors are provided with a clear field of regard, thus improving accuracy of the munition 500 and/or correct initiation time of the munition 500.

The fuze 420 may be located in the aftmost section 414. In this way, the fuze 420 is provided in an improved location, separated from the rotatable section 432.

FIG. 5 shows a munition 500 comprising the fuze system 400, in accordance with an example. The munition 500 may comprise, or be, a projectile. Optionally, the munition comprises, or is, an unpropelled projectile. Unpropelled projectiles tend to be cheaper than its more complex alternatives, such as guided missiles. In one example, the projectile comprises an artillery munition, a mortar munition, and/or a tank munition. The munition may be, or comprise, a spin-stabilised munition or a mortar.

Fuze subsystems (such as a safe and arm mechanism, initiation device, booster charge, or the like) may be housed in the foremost section 412 of the body 410 and/or the aftmost section 414 of the body 410. This is facilitated by the provision of the power generator 430 located behind the foremost section 412 and/or between the foremost section 412 and the aftmost section 414. In this way, improvements in usage of space in the body 410 is facilitated.

The fuze system 400 may be configured to be attached to a front of a munition body 502. As such, the installation of the fuze system 400 on existing munitions can be simplified. Furthermore, as the fuze system 400 is attached to a munition body 502, and is not placed within, or integral to, the munition body 502, the fuze system 400 does not take up the valuable space available within the munition body 502. As such, the munition body 502 can easily store other components (such as an explosive charge, and/or sensors) within itself, without compromising on space. That is, the fuze system 400 may modify the existing fuze, rather than modifying the entirety of the munition body 502.

Additionally, by attaching the fuze system 400 to the front of the munition body 502, the power generating abilities of the power generator 430 can be maximised as, in a typical scenario, the airstream engaging elements 434 get maximum exposure to the airstream around the fuze system 400. That is, the elements 434 are not obstructed, or covered by, any other elements of the munition 500.

The fuze system 400 is configured to be attached to the munition body 500 by virtue of the outer screw thread 416 of the aftmost section 414 of the body 410 engaging an inner screw thread provided in a foremost section/region of the munition body 500.

An outer profile of the fuze system 400 at a point of attaching to the munition body 502 may be the same as an outer profile of the munition such that, when attached to the munition body 502, the fuze system 400 substantially continues the outer profile of the munition body 502. By continuing the shape of the munition body 502, drag can be minimised. In one example, the fuze system 400 may be ogive-shaped or roundly-shaped or tapering, in accordance with the typical shape of the munitions, for greater aerodynamic performance.

Furthermore, by ensuring that an outermost diameter of the fuze system 400 does not extend beyond an outermost diameter of the munition body 502 (i.e. by ensuring that the fuze system 400 does not have any protrusions that would extend beyond the outermost diameter of the munition body 502), the likelihood of damaging the fuze system 400, or indeed the munition body 502, when handling, loading, or ramming can be reduced.

Figure 6:
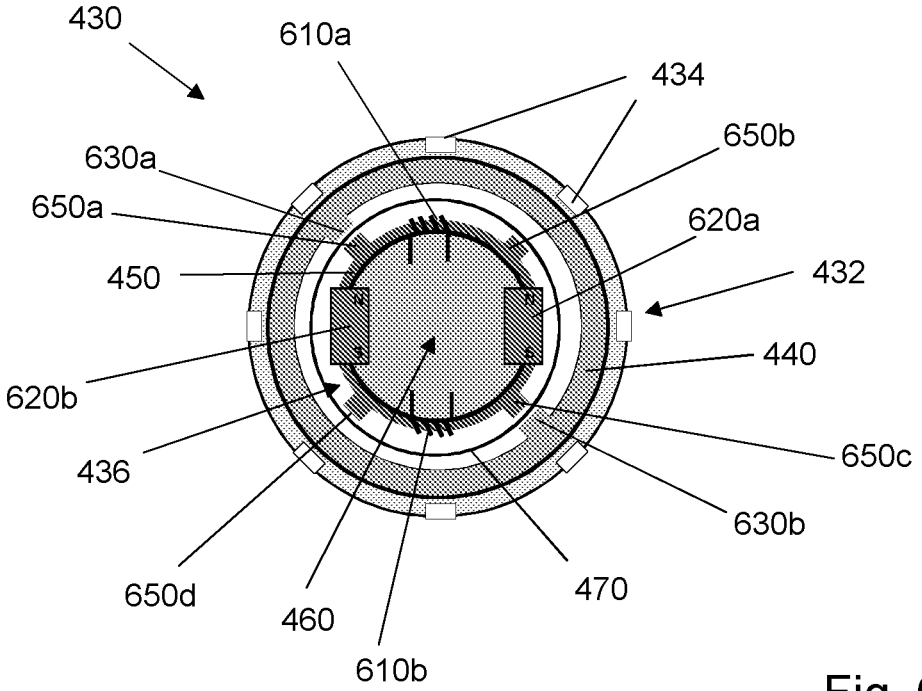
FIG. 6 shows a cross-sectional view of the power generator of the fuze system of FIG. 4.

The construction of the power generator 430 will now be described in greater detail, with reference to FIGS. 6 and 7.

The power generator 430 comprises a rotor 440 and a stator 450. Advantageously, rotation of the rotor 440 about the stator 450 facilitates the generation of electrical power. The rotor 440 and stator 450 may be formed of materials having low reluctance (e.g., low reluctance materials, such as soft iron). In this way, the rotor 440 and stator 450 a high magnetic flux can be generated in the rotor 440 and stator 450. The stator 450 may otherwise be referred to as an armature.

As introduced above, the power generator 430 comprises a rotatable section 432. The rotor 440 and rotatable section 432 may be formed separately, as distinct components, and subsequently connected. In such an example, the rotor 440 and rotatable section 432 are connected such that rotation of the rotatable section 432 causes rotation of the rotor 440. For example, the rotor 440 and rotatable section 432 may be fixedly (or rigidly) connected. In this way, rotation of the rotatable section 432 due to interaction with airflow directly leads to rotation of the rotor 440, leading to generation of electrical power by the power generator 430.

Alternatively, the rotor 440 and rotatable section 432 may be integrally (i.e., one piece) formed. That is, the rotor 440 and rotatable section 432 may be the same component.

Furthermore, as introduced above, the power generator 430 comprises a a stationary/fixed section 436. The stationary section 436 of the power generator 430 comprises the stator 450.

The rotor 440 has the form of an annulus or ring. The stator 450 has the form of an annulus or ring. The rotor 440 surrounds the stator 450. That is, the stator 450 is provided inside, or within, the rotor 440. In this way, the rotor 440 rotates about, or around, the stator 450. This is in contrast to conventional rotor and stator constructions, which provide the rotor to rotate within the stator. Whilst this may seem like a subtle distinction, it is highly advantageous as it enables the rotational energy of the rotating section 432 to be used to rotate the rotor 440 to provide electrical power generation. Furthermore, this leads to mechanically simpler construction and a more compact design.

The power generator 430 may comprise a variable reluctance alternator. That is, the rotor 440 and stator 450 may be components of a variable reluctance alternator. The variable reluctance alternator is configured to generate an alternating electric current.

Employing the variable reluctance alternator is highly advantageous for a number of reasons. The variable reluctance alternator is structurally simple and robust. Permanent magnets provided in the stator facilitate simple cooling of the alternator. A sinusoidal electromotive force is generated. Due to the short end windings, there are low copper losses in the alternator. High power density is generated. The variable reluctance alternator can provide an electromagnetic torque even higher than permanent magnet synchronous machines. Finally, the variable reluctance alternator is fault tolerant.

The power generator 430 further comprises a plurality of coils 610*a*, 610*b* wound onto the stator 450. In this example, the power generator 430 comprises a first coil 610*a* and a second coil 610*b*. The first coil 610*a* and second coil 610*b* are diametrically opposed on either side of the stator 450.

The power generator 430 further comprises a power supply/storage and circuitry unit 460. The power supply/storage and circuitry unit 460 may comprise a printed circuit board (PCB). The power supply/storage and circuitry unit 460 is mounted in the stator 450. The power supply/storage and circuitry unit 460 is connected to the coils 610*a*, 610*b*. In this way, electrical current generated in the coils 610*a*, 610*b* can be stored and directed to other components of the fuze system 400. The power supply/storage and circuitry unit 460 may be configured to store power only, that is, may be a power storage and circuitry unit 460.

The power generator 430 further comprises a plurality of permanent magnets 620*a*, 620*b*. In this example, the power generator 430 comprises a first permanent magnet 620*a* and a second permanent magnet 620*b*. The first permanent magnet 610*a* and second permanent magnet 620*b* are diametrically opposed on either side of the stator 450. The permanent magnets 620*a*, 620*b* are provided between the coils 610*a*, 610*b*.

As introduced above, the rotor 440 has the form of a ring. The rotor 440 is arranged to rotate about the stator 450. The rotor 440 comprises a plurality of teeth 630*a*, 630*b*. In the example illustrated, the rotor 440 comprises a first tooth 630*a* and a second tooth 630*b*. In this way, manufacture of the rotor 440 is simpler when compared with a rotor 440 having a greater number of teeth. In a preferred example, the rotor 440 comprises 2 to 6 teeth, and in a most preferred example, the rotor 440 comprises 6 teeth. In this way, the cycle rate of current generation and generation efficiency of the power generator 430 is increased, for example compared with a rotor comprising fewer teeth.

The stator 450 comprises a plurality of teeth 650*a-d*. In the example illustrated, the stator 450 comprises a first tooth 650*a*, a second tooth 650*b*, a third tooth 650*c*, and a fourth tooth 650*d*. The teeth 650*a-d* extend outwardly from the stator 450. The teeth 650*a-d* are equidistantly spaced around the ring stator 450. The first tooth 650*a* and third tooth 650*c* are diametrically opposed, and the second tooth 650*b* and fourth tooth 650*d* are diametrically opposed.

Figure 7:
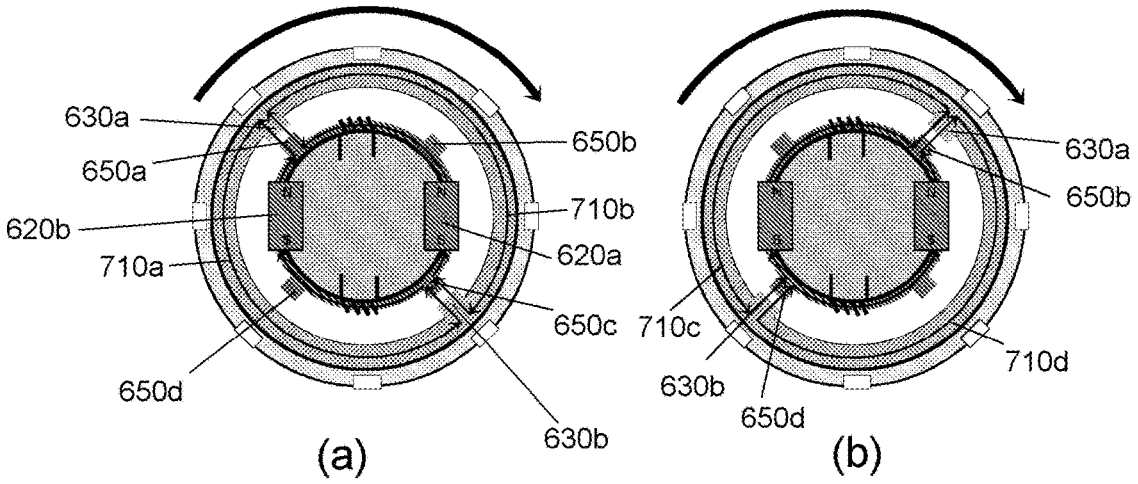
FIG. 7 shows generation of electrical power in the power generator of FIG. 6.

FIG. 7 shows snapshots of the power generator 430. In FIG. 7(*a*), the rotor 440 is in a first position. In FIG. 7(*b*), the rotor 440 is in a second position. The rotor 440 and stator 450 provide low reluctance pathways for magnetic field/flux lines 710*a-d*.

Referring to FIG. 7(*a*), in the first position, the first tooth 630*a* of the rotor 440 is proximal to the first tooth 650*a* of the stator 450, and the second tooth 630*b* of the rotor 440 is proximal to the third tooth 650*c* of the stator 450. In describing the positioning of the rotor 440 relative to the stator 450, the term proximal may mean "aligned with".

Referring to FIG. 7(*b*), in the second position, the first tooth 630*a* of the rotor 440 is proximal to the second tooth 650*b* of the stator 450, and the second tooth 630*b* of the rotor 440 is proximal to the fourth tooth 650*d* of the stator 450.

Whilst not shown, it will be appreciated that the rotor 440 continues to rotate to a third position wherein the first tooth 630*a* of the rotor 440 is proximal to the third tooth 650*c* of the stator 450, and the second tooth 630*b* of the rotor 440 is proximal to the first tooth 650*a* of the stator 450, and then to a fourth position wherein the first tooth 630*a* of the rotor 440 is proximal to the fourth tooth 650*d* of the stator 450 and the second tooth 630*b* of the rotor 440 is proximal to the second tooth 650*b* of the stator 450.

As described above, the rotor 440 moves between the proximal/aligned positions due to rotation of the rotatable section 432, which may be caused by interaction with an airstream.

When the rotor 440 rotates, the flux lines 710*a-d* are alternatively guided in such a way that flux linked through the coils 620*a*, 620*b* periodically switches and induces an alternating electromotive force in the coils 620*a*, 620*b*, provided at (e.g., wound over) the stator 450. It can be seen that there is a change in direction of the magnetic field lines through the coils 620*a*, 620*b* between the first position (FIG. 7(*a*)) and second position (FIG. 7(*b*)). Then, flux-linkage, and the EMF induced in the phase windings, are sinusoidal functions that depend on the position of the rotor 440. In each of the first position and second position, the flux linkage has the same value but the polarity is reversed. Thus, an alternating current is generated by the power generator 430. The alternating current and/or voltage may be proportional to the rate of rotation of the rotor 440, which may be proportional to the speed of the airstream/flight speed of the munition 500.

Referring back to FIG. 6, a support 470 extends through the power generator 430. The support 470 extends through the power generator 430 between the rotor 440 and the stator 450. The support 470 has the form of a tube. The support 470 connects the foremost section 412 and aftmost section 414 of the body 410 of the fuze system 400. The support 470 may support the aft thrust bearing on which the rotatable section 432 is arranged to rotate.

The support 470 may be formed of a low permeability material (such as aluminium alloy), or may be perforated. In this way, low reluctance pathways are provided. In this way, the support 470 may be provided between the rotor 440 and stator 450 without disrupting the magnetic flux lines which are set up in rotor 440 and stator 450 when the teeth are proximal/aligned.

The power generator 430 may be configured to provide electrical power to a safe and arm mechanism, or safe/arm unit. The safe and arm mechanism may be housed in the aftmost section 414 of the body 410. Advantageously, in this way, the safe and arm mechanism may be provided with electrical power during flight of the munition.

The power generator 430 may be employed as a sensor to provide a sensing input. The sensing input may be provided to the safe and arm mechanism. That is, the power generator 430 may be configured to provide a sensing input to the safe and arm mechanism. The sensing input may be used as part of an arming sequence of the safe and arm mechanism. Additionally, or alternatively, the sensing input may be used for navigational purposes, e.g., provided to a navigation system.

In one example, where the power generator 430 is configured to provide a sensing input to the safe and arm mechanism, the power generator 430 may detect motion of the fuze system 400 or munition 500 due to rotation of the rotatable section 432. The power generator 430 may determine that the rotatable section 432 is rotating at or above a predetermined velocity, for example by reference to the AC frequency of current generated by the power generator 430, for a particular period of time. Such a determination may be used to confirm that the fuze system 400 or munition 500 is in flight at a safe distance from the launch location, such that an arming sequence of the safe and arm mechanism can or should commence.

In another example, where the power generator 430 is configured to provide a sensing input to a navigation system, the power generating may determine the velocity of the fuze system 400 by reference to the AC frequency of the current generated by the power generator. In combination with the time-of-flight of the fuze system 400, the distance travelled by the fuze system 400 or munition 500 can be determined.

It will be appreciated that the frequency measurements are more robust that voltage/current levels, so frequency measurements would be the preferred parameter of the alternator output to use in producing the sensing input.

Figure 8:
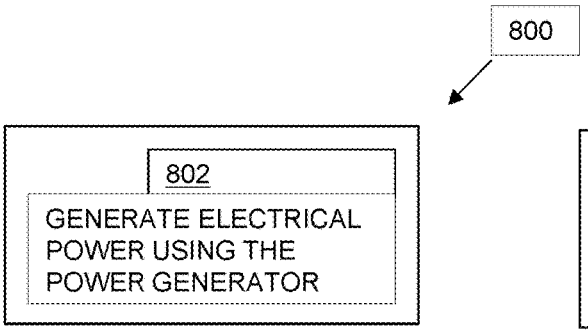
FIG. 8 shows general methodology principles.

FIG. 8 shows a method 800 of using a fuze system, in accordance with an example. The fuze system used in this method comprises a body, a fuze located in the body, and a power generator, attached to the body, for generating electrical power and providing it to the fuze system, the power generator configured to generate electrical power by interacting with an airstream around the fuze system. The fuze system may be, for example, the fuze system 100 described herein.

In step 802, the method comprises generating electrical power using the power generator. As explained above in relation to FIG. 1, the power generator may be used to supply electrical power for sensors used in and/or with the fuze system (such as impact sensors), various communication and control modules, and/or to supply power to an electrical fuze. Interaction of the power generator with the airstream around the fuze system may occur after a munition (the body of which the fuze system is attached to) has been launched into the air, for example from a gun barrel. The advantage of using the power generator described herein is that, since the power generator is configured to generate electrical power by interacting with the airstream around the fuze system, the need to employ a chemical energiser is eliminated.

Figure 9:
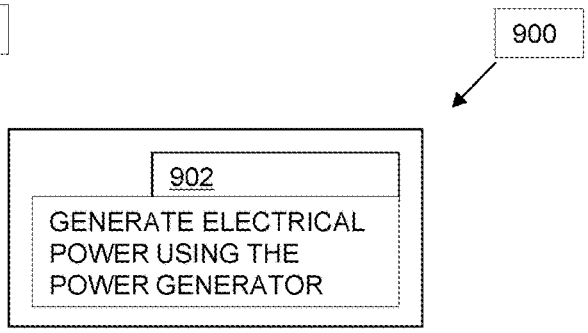
FIG. 9 shows general methodology principles.

FIG. 9 shows a method 900 of using a fuze system, in accordance with an example. The fuze system used in this method comprises a body comprising a foremost section; a fuze located in the body; a power generator, attached to the body, for generating electrical power and providing it to the fuze system, the power generator configured to generate electrical power by interacting with an airstream around the fuze system, wherein at least a part of the power generator is located behind the foremost section, the at least a part of the power generator being arranged to rotate relative to the foremost section of the body. The fuze system may be, for example, the fuze system 400 described herein.

In Step 902, the method comprises generating electrical power using the power generator. As explained above in relation to FIG. 4, the power generator may be used to supply electrical power for sensors used in and/or with the fuze system (such as impact sensors), various communication and control modules, and/or to supply power to an electrical fuze. Interaction of the power generator with the airstream around the fuze system may occur after a munition (the body of which the fuze system is attached to) has been launched into the air, for example from a gun barrel. The advantage of using the power generator described herein is that, since the power generator is configured to generate electrical power by interacting with the airstream around the fuze system, the need to employ a chemical energiser is eliminated.

Furthermore, the combination of location and rotation of the at least a part of the power generator 430 is highly advantageous in combination and provides a synergistic effect. By such a construction, the foremost section 412 may be configured to remain static during flight, such that the foremost section 412 may be used for housing sensors, such as target sensors, without needing to account for rotation of the foremost section 412 of the body 410. Furthermore, by such a construction, the rotating part of the power generator 430 may be spatially separated from the foremost section 412, such that the foremost section 412 may be free of hardware (which may include rotating components) associated with the power generator 430.

Additionally, the at least a part of the power generator 430 being located behind the foremost section 412 is highly advantageous. In this way, the foremost section 412 of the body 410 need not be used for housing the power generator 430. Improved used of space in the body 410 of the fuze system 400 is thus made. Additionally, the foremost section 412 is thus available for other fuze subsystems. For example, sensors, such as target sensors, may be located in the foremost section 412 of the body 410, where the sensors are provided with a clear field of regard, thus improving accuracy of the munition 500 and/or correct initiation time of the munition 500.

The invention claimed is:

1. A fuze system for attaching to a munition body, the fuze system comprising:

a body comprising a foremost section;

a fuze located in the body; and a power generator, attached to the body, for generating electrical power and providing it to the fuze system, the power generator configured to generate electrical power by interacting with an airstream around the fuze system, wherein at least a part of the power generator is located behind the foremost section, the at least a part of the power generator being arranged to rotate relative to the foremost section of the body, wherein the power generator comprises one or more recesses, channels, and/or grooves extending into or below a surrounding surface and configured to interact with the airstream around the body, and wherein an outermost diameter of the power generator, including the one or more recesses, channels, and/or grooves, does not extend beyond an outermost diameter of the body.

2. The fuze system of claim 1, wherein the one or more recesses, channels, and/or grooves are configured to interact with the airstream around the fuze system such that the at least a part of the power generator rotates around at least a portion of the body.

3. The fuze system of claim 1, wherein the entire power generator is located behind the foremost section.

4. The fuze system of claim 1, the body further comprising an aftmost section, the at least a part of the power generator located between the foremost section and aftmost section of the body, the at least a part of the power generator being arranged to rotate relative to the foremost section and aftmost section of the body.

5. The fuze system of claim 4, wherein the power generator is located between the foremost section and aftmost section of the body.

6. The fuze system of claim 1, wherein the power generator comprises a rotor and a stator.

7. The fuze system of claim 6, wherein the power generator comprises a variable reluctance alternator.

8. The fuze system of claim 6, wherein the rotor is fixedly connected to the at least a part of the power generator.

9. The fuze system of claim 6, wherein the rotor has the form of a ring, the rotor being arranged to rotate about the stator.

10. The fuze system of claim 9, wherein the rotor comprises a plurality of teeth.

11. The fuze system of claim 10, wherein the rotor comprises 2 to 6 teeth.

12. The fuze system of claim 1, wherein the power generator is configured to provide electrical power to a safe and arm mechanism.

13. A munition comprising the fuze system of claim 1.

14. The munition of claim 13, wherein fuze subsystems are housed in a foremost section of the body and/or the aftmost section of the body.

15. A method of using a fuze system, the fuze system including a body, a fuze, and a power generator, the body comprising a foremost section, the fuze located in the body, and the power generator, which is attached to the body, is configured to generate electrical power for the fuse system by interacting with an airstream around the fuze system, wherein at least a part of the power generator is located behind the foremost section, the at least a part of the power generator being arranged to rotate relative to the foremost section of the body, the method comprising:

generating electrical power using the power generator, wherein the power generator comprises one or more recesses, channels, and/or grooves extending into or below a surrounding surface and configured to interact with the airstream around the body, and wherein an outermost diameter of the power generator, including the one or more recesses, channels, and/or grooves, does not extend beyond an outermost diameter of the body.

16. A fuze system for attaching to a munition body, the fuze system comprising:

a body comprising a foremost section and an aftmost section;

a fuze located in the body; and a power generator including a rotor and a stator, the power generator attached to the body and configured to generate electrical power for the fuze system by interacting with an airstream around the fuze system, wherein at least a part of the power generator is located between the foremost section and aftmost section of the body, the at least a part of the power generator being arranged to rotate relative to the foremost section and aftmost section of the body, and wherein the at least a part of the power generator comprises a plurality of airstream engaging elements, wherein the airstream engaging elements comprise one or more recesses, channels, and/or grooves extending into or below a surrounding surface and configured to interact with the airstream around the body, and wherein an outermost diameter of the power generator, including the one or more recesses, channels, and/or grooves, does not extend beyond an outermost diameter of the body.

17. The fuze system of claim 16, wherein: the rotor is fixedly connected to the at least a part of the power generator; and the rotor has the form of a ring, the rotor being arranged to rotate about the stator.

18. The fuze system of claim 16, wherein the power generator is configured to provide electrical power to a safe and arm mechanism.

* * * * *